US008257803B2

(12) United States Patent
Shimada et al.

(10) Patent No.: US 8,257,803 B2
(45) **Date of Patent: *Sep. 4, 2012**

(54) INKJET RECORDING MEDIUM AND INKJET RECORDING METHOD

(75) Inventors: Hirokazu Shimada, Fujinomiya (JP); Tomoya Kubota, Fujinomiya (JP)

(73) Assignee: FUJIFILM Corporation, Tokyo (JP)

( * ) Notice: Subject to any disclaimer, the term of this patent is extended or adjusted under 35 U.S.C. 154(b) by 982 days.

This patent is subject to a terminal disclaimer.

(21) Appl. No.: 12/203,665

(22) Filed: Sep. 3, 2008

(65) Prior Publication Data

US 2009/0068360 A1 Mar. 12, 2009

(30) Foreign Application Priority Data

Sep. 7, 2007 (JP) ..... 2007-233175

(51) Int. Cl.
*B41M 5/00* (2006.01)

(52) U.S. Cl. ..... 428/32.22; 428/32.24; 428/32.26; 428/32.28; 428/32.34; 347/101; 347/105

(58) Field of Classification Search ..... 428/32.22, 428/32.24, 32.26, 32.28, 32.34; 347/101, 347/105

See application file for complete search history.

(56) References Cited

U.S. PATENT DOCUMENTS

| | | | | |
|---|---|---|---|---|
| 5,988,635 | A | 11/1999 | Ohshima | |
| 6,610,389 | B2 | 8/2003 | Ishimaru et al. | |
| 2001/0016249 | A1* | 8/2001 | Kitamura et al. | 428/195 |
| 2005/0064115 | A1* | 3/2005 | Suzuki et al. | 428/32.34 |
| 2009/0068360 | A1 | 3/2009 | Shimada et al. | |

FOREIGN PATENT DOCUMENTS

| | | | |
|---|---|---|---|
| EP | 0 742 107 | | 11/1996 |
| EP | 0 742 107 | A2 | 11/1996 |
| EP | 1 369 257 | | 12/2003 |
| EP | 1 369 257 | A1 | 12/2003 |
| JP | 03-56552 | B | 10/1985 |
| JP | 03-056552 | B2 | 10/1985 |
| JP | 62-174183 | | 7/1987 |
| JP | 62-174183 | A | 7/1987 |
| JP | 02-276670 | | 11/1990 |
| JP | 02-276670 | A | 11/1990 |
| JP | 05-032037 | | 2/1993 |
| JP | 05-032037 | A | 2/1993 |
| JP | 06-199034 | | 7/1994 |
| JP | 06-199034 | A | 7/1994 |
| JP | 06-278357 | | 10/1994 |
| JP | 06-278357 | A | 10/1994 |
| JP | 07-017128 | | 1/1995 |
| JP | 07-266550 | | 10/1995 |
| JP | 07-276781 | | 10/1995 |
| JP | 07-276781 | A | 10/1995 |
| JP | 09-286165 | | 11/1997 |
| JP | 09-286165 | A | 11/1997 |
| JP | 10-119423 | | 5/1998 |
| JP | 10-119423 | A | 5/1998 |
| JP | 10-120234 | | 5/1998 |
| JP | 10-181190 | | 7/1998 |
| JP | 10-181190 | A | 7/1998 |
| JP | 2000-006513 | | 1/2000 |
| JP | 2000-006513 | A | 1/2000 |
| JP | 2000-211235 | | 8/2000 |
| JP | 2000-211235 | A | 8/2000 |
| JP | 2000-309157 | | 11/2000 |
| JP | 2000-309157 | A | 11/2000 |
| JP | 2001-072274 | | 3/2001 |
| JP | 2001-277712 | | 10/2001 |
| JP | 2001-277712 | A | 10/2001 |
| JP | 2002-144701 | | 5/2002 |
| JP | 2002-274010 | | 9/2002 |
| JP | 2002-292997 | | 10/2002 |
| JP | 2003-048373 | | 2/2003 |
| JP | 2003-291483 | | 10/2003 |
| JP | 2003-291506 | | 10/2003 |
| JP | 2004-174729 | | 6/2004 |
| JP | 2004-181761 | | 7/2004 |
| JP | 2004-181761 | A | 7/2004 |
| JP | 2004-299162 | | 10/2004 |
| JP | 2005-054308 | | 3/2005 |
| JP | 2005-205765 | | 8/2005 |
| JP | 2005-205765 | A | 8/2005 |
| JP | 2006-001028 | | 1/2006 |
| JP | 2006-142488 | | 6/2006 |

(Continued)

OTHER PUBLICATIONS

EP Communication, dated Dec. 9, 2008, issued in corresponding EP Application No. 08015603.7, 5 pages.

(Continued)

*Primary Examiner* — Betelhem Shewareged
(74) *Attorney, Agent, or Firm* — Sughrue Mion, PLLC

(57) ABSTRACT

An inkjet recording medium comprising a support, an ink receiving layer containing fine particles and a water-soluble resin, and a back coat layer containing a specific resin, and satisfying the equation $B>-30A+4C+37$, wherein A is a static friction coefficient between the uppermost surface at the back coat layer side of the support and a metal roller onto which wear-resistant particles are adhered, B is an amount of deformation of the overall layer(s) on the back coat layer side of the support B (μm), and C is an overall rigidity of the layers including the support, the ink receiving layer and the back coat layer (mN·m), and A, B and C are within the ranges of $0.84>A>0.44$, $32>B>20$ and $5>C>2$, respectively.

17 Claims, 1 Drawing Sheet

FOREIGN PATENT DOCUMENTS

| | | | |
|---|---|---|---|
| JP | 2006-207055 | | 8/2006 |
| JP | 2006-263951 | | 10/2006 |
| JP | 2006263951 | A | 10/2006 |
| JP | 2006-305997 | | 11/2006 |
| JP | 2007-107141 | | 4/2007 |
| JP | 2007107141 | A | 4/2007 |
| WO | 2004/076744 | A1 | 9/2004 |
| WO | WO 2004/076744 | | 9/2004 |

OTHER PUBLICATIONS

Japanese Office Action dated Dec. 20, 2011 corresponding to JP 2007-233175.

Notice of Reasons for Rejection, dated Dec. 20, 2011, issued in JP Application No. 2007-233175, 4 pages in English and Japanese.

Notice of Reasons for Rejection, dated Sep. 13, 2011, issued in JP Application No. 2007-231479, 5 pages in English and Japanese.

EP Communication, dated Dec. 9, 2008, issued in EP Application No. 08015603.7, 5 pages.

EP Communication, dated May 12, 2009, issued in EP Application No. 08015546.8, 7 pages.

Notice of Reasons for Rejection, dated Dec. 20, 2011, issued in JP Application No. 2007-231479, 5 pages in English and Japanese.

* cited by examiner

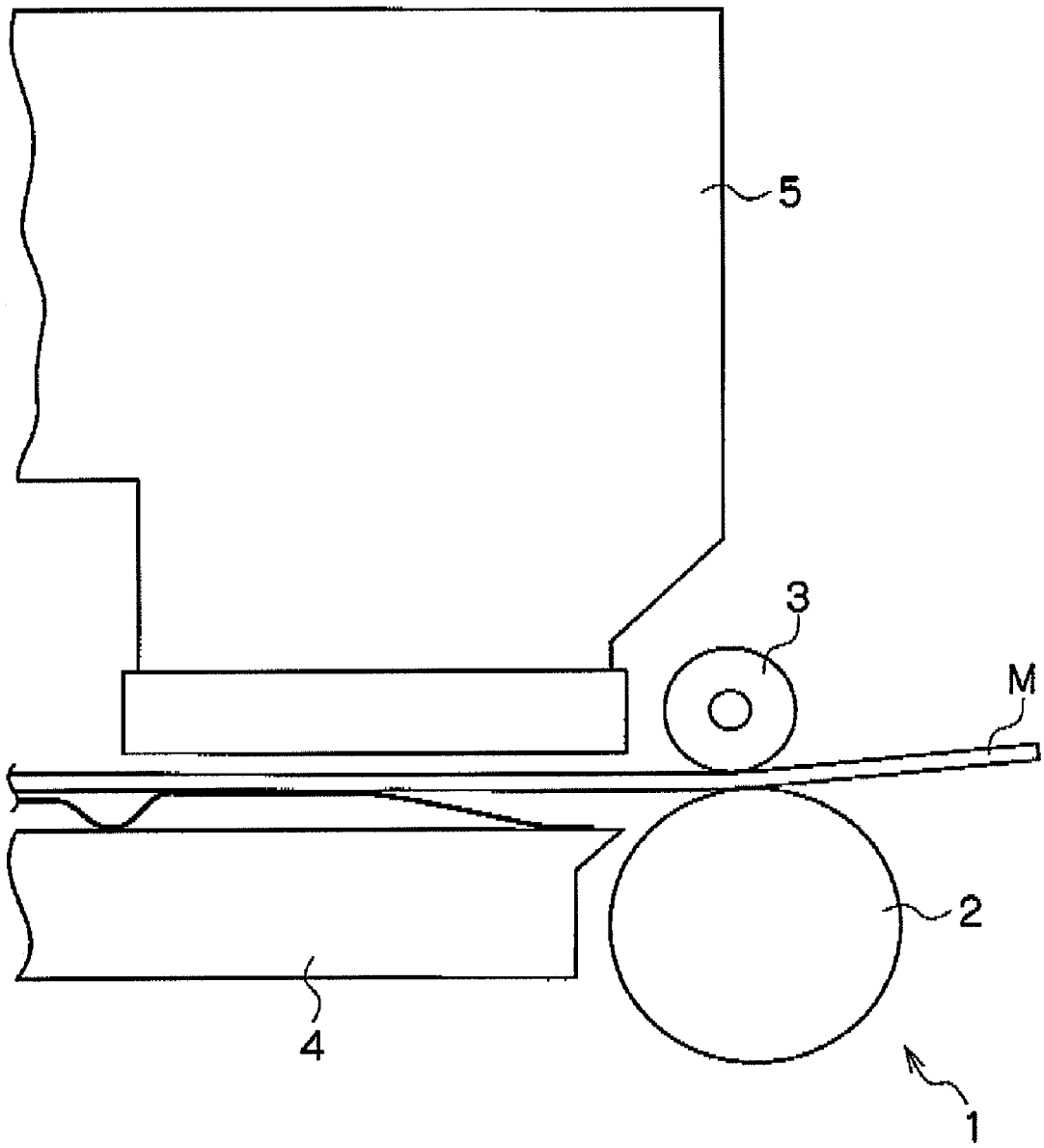
5
3
M
2
4
1

INKJET RECORDING MEDIUM AND INKJET RECORDING METHOD

CROSS-REFERENCE TO RELATED APPLICATION

This application claims priority under 35 USC 119 from Japanese Patent Application No. 2007-233175, the disclosure of which is incorporated by reference herein.

BACKGROUND OF THE INVENTION

1. Field of the Invention

The present invention relates to an inkjet recording medium suitable for recording an image by applying ink thereto by an inkjet process, and to an inkjet recording method.

2. Description of the Related Art

In an inkjet recording system ink droplets ejected from an ejecting outlet of a recording head are adhered onto a recording medium such as paper to record an image thereon.

In inkjet recording, in particular, in color inkjet recording, a high degree of ink absorbancy is required for recording materials due to the use of a large amount of aqueous ink. As a recording material suitable for inkjet recording which has excellent ink absorbancy, a recording material is known in which a porous ink receiving layer containing a pigment such as amorphous silica and a water-soluble resinous binder such as polyvinyl alcohol is provided on a support.

In recent years, recording materials with a photo-like glossiness using inorganic ultra-fine particles as a pigment have been developed. For example, it has been proposed to use, as a pigment component for an ink receiving layer, inorganic ultra-fine particles of fumed silica, precipitated silica and the like that have been pulverized to a size of 500 nm or less and dispersed. For examples of fumed silica used in this manner, see Japanese Patent Publication No. 3-56552 and Japanese Patent Application Laid-Open (JP-A) Nos. 10-19423, 2000-211235 and 2000-309157; for examples of use of silica produced by a method including pulverization and sedimentation, see JP-A Nos. 9-286165 and 10-181190, and for examples of use of silica produced by a pulverization gel method, see JP-A No. 2001-277712. Recording materials using alumina or alumina hydrates have also been disclosed (for example, see JP-A Nos. 62-174183, 2-276670, 5-32037 and 6-199034).

However, when inorganic ultra-fine particles such as these are used, although a high degree of glossiness and a high degree of ink absorbancy may be obtained, the viscosity of a coating liquid tends to increase. Therefore, the coating liquid has to be coated and dried at a low solid concentration. In particular, in recent years, in order to obtain high glossiness and an excellent texture that resembles that of photographic printing paper, or to prevent the occurrence of cockling in recording materials due to a large quantity of ejected ink, polyolefin resin-coated paper (wherein both surfaces of a paper substrate are laminated with a polyolefin resin such as polyethylene) is suitably used. However, in resin coated paper such as this, it is necessary to apply and dry a larger amount of a coating liquid at a low solid concentration, since the support cannot absorb ink, and therefore, there is a problem that productivity cannot be increased.

Further, it is known that inkjet recording materials using polyolefin resin-coated paper exhibit inferior sheet conveyance properties and inferior accuracy in conveyance in a printer, compared with inkjet recording materials that use paper as a support.

One problem with paper conveyance is that a paper coated with a polyolefin resin cannot be conveyed to a predetermined position for printing in a printer with high accuracy, and tends to cause non-feeds (feeding malfunctions), resulting in difficulties with successive printing. In general, inkjet recording materials are stacked on a paper feed tray in an inkjet printer, and one important property of a recording material is favorable paper feedability, namely, that the recording material may be smoothly fed from a paper feed tray to a printer main body.

Further, inkjet recording materials using inorganic ultra-fine particles are extremely susceptible to external stress, since ink absorbancy of the coating layer is increased, which leads to another problem relating to paper feedability, namely that, when several tens of sheets are stacked and successively printed, the ink receiving layer, which is the front side surface of a recording material, is damaged by the back side surface of another recording material. Polyolefin-coated paper is often designed to have a high rigidity in order to obtain a texture similar to that of silver salt photographic printing paper. Accordingly, inkjet recording materials using polyolefin-coated paper may cause paper feed malfunctions and, further, polyolefin resin-coated paper is often used for photographic printing paper, and since it often contains pigment particles in a back coating layer formed on the back side thereof, there is a problem that a paper is damaged by the pigment particles during successive printing.

With regard to problems of sheet feeding accuracy, when sheet feeding accuracy is low, a portion of a recording material in which an image is to be printed is conveyed to a position deviating from a predetermined printing position. Consequently, favorable printing quality may not be achieved due to the occurrence of streaked unevenness along a main scanning direction of a scanning head in a background solid area or the like, known as banding, or the occurrence of streaked non-printed portions along the main scanning direction of a scanning head, known as white deletion.

Here, with reference to FIG. 1, a paper feed mechanism in a common inkjet printer will be schematically explained. As shown in FIG. 1, an inkjet printer is equipped with a paper feed roller 1. The paper feed roller 1 is formed from a pair of rollers: a drive roller 2 that contacts a back surface of a recording material M, and a driven roller 3 that contacts a front surface (recording surface) of the recording material M. The inkjet printer is further equipped with a platen 4 and a recording head 5. The drive roller 2 is rotatably driven by a drive motor as a drive source and the number of revolutions thereof is simultaneously controlled, and the driven roller 3 is rotated in accordance with the rotation of the drive roller 2. The recording material M is nipped by nip portions of the rollers, and conveyed to a position of the platen 4, and the feed amount thereof is simultaneously controlled in accordance with print data transmitted from a host computer or the like. At the position of the platen 4, ink ejection from the recording head 5 is performed in synchronization with the control of the feed amount, by which ink is adhered on the recording material in each unit area according to a predetermined pattern to form an image.

In such a paper feed mechanism, it is important that the feed amount of recording material by the feed roller 1 is controlled with a high degree of accuracy. If the accuracy of control of the feed amount is low, positions at which ink droplets are impacted may deviate from their intended positions, which may result in the occurrence of banding or white deletion. Therefore, in order to perform paper feeding with a high degree of accuracy, a roller having a surface with asperity (surface asperity roller) has been adopted as the drive roller 2 that constitutes the paper feed roller 1. Since the surface of the surface asperity roller that comes in contact with a recording material has a high static friction coefficient, the roller can ensure a sufficient static friction coefficient even for a slippery material such as film, and can convey the recording material with high accuracy.

However, when an inkjet recording material using a polyolefin resin-coated paper is used in such a printer which is provided with a surface asperity roller as a paper feed roller (drive roller), and which is expected to perform conveyance with a high accuracy, slippage tends to occur between a back coat layer on a back side of the recording material and the drive roller. For this reason, problems occur such as reduction in sheet feeding accuracy or the occurrence of banding or white deletion.

In relation to the above, various studies have been made regarding improvements in accuracy of sheet feeding in a printer. For example, a technique of coating a back surface of a recording material with a solution formed by mixing tabulate delaminated kaolin clay and hydrated aloisite with a modified PVA and an SBR (Tg=29.5° C.) has been proposed (for example, see JP-A No. 6-278357).

In order to control the feed amount in a feed system employing a metal roller, laminating a back coat layer on a back surface opposite to a recording surface of a recording material has been proposed (for example, see JP-A No. 7-276781). Further, a technique of applying a mixture of colloidal silica with an average particle diameter of 0.5 μm or less and a resin for adhesion at a ratio of 40:100 on a back surface of a recording material at an amount of 5 g/m$^2$ has been proposed (for example, see JP-A No. 2000-6513). Further, it has been proposed that a composition containing 70% by mass or more of a polyurethane resin (Tg=−10° C. to 120° C.) with respect to the total solid content of a back coat layer is applied onto a recording material at a thickness of from 0.6 μm to 1.5 μm (see, for example, JP-A No. 2005-205765).

However, in the technique disclosed in JP-A No. 6-278357, the ratio of inorganic fine particles to PVA and SBR is high, and the coating amount is also large, and therefore feeding accuracy during high speed printing may decrease due to a low static function coefficient with respect to a metal roller, even though paper feeding properties with respect to a pickup roll are excellent. Additionally, as described above, in a recording material having a back coat layer simply laminated on a back surface opposite to a recording surface, the static friction coefficient between the front surface and the back surface may not be taken into account, and thus there is a possibility that double feeding, in which two sheets are fed into a printer at the same time, may occur. Further, there is no clear discussion on polymer materials used for the back coat layer, and the feedability may even be worsened by the provision of a back coat layer.

In the technique of applying a mixture of colloidal silica and a resin for adhesion at a predetermined ratio to a back surface of a recording medium, a large application amount thereof causes deposition of a fine powder of colloidal silica onto portions of a metal roller having asperity due to continuous operation, resulting in decreased feeding accuracy due to a decrease in the static friction coefficient between the metal roller and the back surface of the recording medium.

Further, as described above, when a given amount or more of a polyurethane resin is used for a coating with a given thickness, the rigidity of a support and a requisite static friction coefficient for the support, as well as an amount of deformation due to the impression of a metal roller to a back surface of the support are not taken into account, even though the range of the rigidity that is applicable to a support may have been defined. Consequently, banding cannot be prevented, and the feeding accuracy is low when printing is performed at high speed due to a small coating amount of the resin on the back surface.

Meanwhile, recent years have seen continuing increases in speed of the operations of printers, and information recording at a higher speed in an inkjet printer has been desired, and consequently there is a demand for further improvement in the feeding accuracy of a recording material in order to maintain a high quality for printed images.

In order to make a recording material applicable for inkjet recording wherein the recording material is fed by a metal roller onto which wear-resistant particles are uniformly adhered, there is a need for the metal roller to hold the recording material at a back surface thereof in an appropriate manner.

Although commercially available recording materials for inkjet recording have applicability to inkjet printers on the market, when the recording speed increases, feeding accuracy may decrease due to insufficient gripping force.

SUMMARY OF THE INVENTION

In view of the above circumstances, a first aspect of the present invention provides an inkjet recording medium comprising:

a support;

at least one ink receiving layer formed on one surface of the support, containing at least fine particles and a water-soluble resin; and a back coat layer that is formed on the other surface of the support, the back coat layer comprising a resin having a stress at break of from 30 to 100 MPa and an elongation at break of from 2 to 40% GL, wherein:

a static friction coefficient between an uppermost surface of the ink receiving layer side of the support and the uppermost surface of the back coat layer side of the support is in the range of from 0.46 to 0.77, and wherein the following equation is satisfied:

$$B>-30A+4C+37$$

wherein A is a static function coefficient between the uppermost surface at the back coat layer side of the support and a metal roller onto which wear-resistant particles are adhered; B is an amount of deformation of the overall layer(s) on the back coat layer side of the support measured in μm; and C is an overall rigidity of the layers including the support, the ink receiving layer and the back coat layer measured in mN·m and wherein A, B and C are within the ranges of 0.84>A>0.44, 32>B>20 and 5>C>2, respectively.

A second aspect of the present invention provides an inkjet recording method comprising applying ink onto an ink receiving layer of an inkjet recording medium, the inkjet recording medium comprising:

a support;

at least one ink receiving layer formed on one surface of the support containing at least fine particles and a water-soluble resin; and a back coat layer that is formed on the other surface of the support, the back coat layer comprising a resin having a stress at break of from 30 to 100 MPa and an elongation at break of from 2 to 40% GL, wherein:

a static friction coefficient between an uppermost surface of the ink receiving layer side of the support and the uppermost surface of the back coat layer side of the support is in the range of from 0.46 to 0.77, and wherein the following equation is satisfied:

$$B>-30A+4C+37$$

wherein A is a static friction coefficient between the uppermost surface at the back coat layer side of the support and a feed roller of an inkjet printer formed from a metal roller onto which wear-resistant particles are adhered; B is an amount of deformation of the overall layer(s) on the back coat layer side of the support (μm); and C is an overall rigidity of the layers including the support, the ink receiving layer and the back coat layer (mN·m) and wherein A, B and C are within the ranges of 0.84>A>0.44, 32>B>20 and 5>C>2, respectively.

BRIEF DESCRIPTION OF THE DRAWING

FIG. 1 is a schematic cross-sectional view of a paper feed mechanism in a common inkjet printer.

DETAILED DESCRIPTION OF THE INVENTION

Hereinafter, an inkjet recording medium and an inkjet recording method using the inkjet recording medium according to the invention will be described in detail.

<Inkjet Recording Medium>

The inkjet recording medium of the invention is formed by providing at least one ink receiving layer on one side of a support and at least one back coat layer on the other side of the support, and satisfies the following features (1) to (3):

(1) the static friction coefficient between the uppermost surface (hereinafter, may be referred to as a "front surface") on the ink receiving layer side of the support (hereinafter, may be referred to as a "front side"), and the uppermost surface (hereinafter, may be referred to as a "back surface") on the back coat layer side of the support (hereinafter, may be referred to as a "back side") is in the range of from 0.46 to 0.77.

(2) the following equation (1) is satisfied $$B>-30A+4C+37 \qquad \text{Equation (1)}$$

In Equation (1), A, B and C each satisfies the relationships of 0.84>A>0.44, 32>B>20, and 5>C>2, where A represents a static friction coefficient between the uppermost surface on the back coat layer side of the support and a feed roller (disposed in the interior of an inkjet printer) formed by adhering wear-resistant particles on a surface of a highly rigid roller such as a metal roller; B represents an amount of deformation (μm) of the overall layer(s) formed on the back coat layer side of the support; and C represents the rigidity (mN·m) of the overall layers including the support, the ink receiving layer and the back coat layer as measured in accordance with JIS P 8125.

(3) the back coat layer contains at least a resin, the resin having a stress at break of from 30 MPa to 100 MPa, and an elongation at break of from 2% GL to 40% GL as measured in accordance with JIS K 7161.

When printing is performed at high speed, there is a need that the highly-rigid roller on which ware-resistance particles are uniformly adhered is pressed against a back surface of an inkjet recording medium, and that the driving force of the highly-rigid roller is transmitted to the recording medium via the back surface thereof in an appropriate manner, so that favorable feeding accuracy can be maintained. In commercially available inkjet printers, in which the driving speed of the metal roller is not so high, the driving force can be appropriately transmitted to the inkjet recording medium. However, in printers that can perform printing at high speed, the drive speed of the metal roller is so high that slippage of the inkjet recording medium may occur on the back surface thereof, causing feeding malfunctions and thereby generating bandings. In order to feed a recording medium properly, it is necessary that the recording medium does not slip even when the metal roller rotates at high speed, and that the driving force of the metal roller is appropriately transmitted to the recording medium. Namely, it is necessary that the rotation speed of the metal roller is equal to the progression rate of the inkjet recording medium. Typically, progression of an inkjet recording medium is controlled by a printer in consideration of some degree of slippage of the inkjet recording medium, and ink is ejected under such conditions. However, when printing is performed at higher speed, slippage of a back surface of the recording medium may become a rate-determining factor. Therefore, there is a need to improve the slippage of the back surface of the recording medium.

In the invention, (1) a static friction coefficient between the uppermost surface (front surface) on an ink receiving layer side of the support, and the uppermost surface (back surface) on a back coat layer side of the support is regulated to be in the range of from 0.46 to 0.77. This static friction coefficient indicates a degree of slippage that is caused between plural sheets of inkjet recording media stacked on top of each other. When the static friction coefficient is less than 0.46, feeding accuracy may decrease and slippage of the recording medium may occur at high-speed printing and when the static friction coefficient exceeds 0.77, scratches may be formed on the surface of the recording medium due to scrape (in particular, on the front surface, and when the ink receiving layer is provided on both sides of the support, both ink receiving layers) at the time of feeding or conveying the recording medium.

In view of the above reasons, the static friction coefficient is preferably in the range of from 0.5 to 0.7, and is more preferably in the range of from 0.5 to 0.65.

The static friction coefficient between the front surface and the back surface of the support can be adjusted, for example, by appropriately selecting the type or amount of constituent components or a degree of surface unevenness of a layer for forming the front surface, and/or by appropriately selecting the type or amount of constituent components or a degree of surface unevenness of a layer for forming the back surface (for example, a back coat layer or another layer that may be additionally provided on the back coat layer).

The static friction coefficient between the front surface and the back surface can be measured in accordance with JIS P 8147, by use of a surface property tester (TRIBOGEAR type 14DR (trade name) manufactured by Shinto Scientific Co., Ltd.) as a measuring instrument.

In the invention, (2) the static friction coefficient A between a highly rigid roller that serves as a feed roller for feeding an inkjet recording medium disposed in the inside of an inkjet printer, and the uppermost surface of a back coat layer side of the support (back surface) is regulated to be in the range of from 0.84>A>0.44. When the static friction coefficient A is less than 0.44, slippage of the recording medium may occur at high-speed printing, and when the static friction coefficient exceeds 0.84, the highly-rigid roller may be pressed against the recording medium too strong, which may result in a wide variation in a feed amount of the recording medium. For the same reasons as above, the static friction coefficient A is preferably in the range of from 0.5 to 0.8, and is more preferably in the range of from 0.55 to 0.75.

The static friction coefficient A can be measured in a similar manner to the above. However, since the highly-rigid roller has a cylindrical form, the measurement is conducted by cutting the roller into a predetermined length, and fixing a 60 mm square stainless steel plate onto a surface (an outer periphery) of the roller with an adhesive. Subsequently, a double-faced adhesive tape is adhered onto a side of the stainless steel plate opposite to the side adhered to the roller, and the roller is fixed to a measuring instrument. Thereafter, a back surface of a test piece of an inkjet recording medium having a desired size (for example, an A-4 size) is placed in contact with a surface of the roller, thereby conducting a measurement of a static friction coefficient at a test speed of 7 mm/minute.

In the invention, the "feed roller for an inkjet printer comprised of a highly-rigid roller onto which wear-resistant particles are uniformly adhered" refers to a metal roller for feeding a recording medium that is designed so as to have an increased friction coefficient between the roller and the surface of an inkjet recording medium, and an increased gripping force. Specifically, a sheet feed roller in which ceramic particles (alumina or silicon carbide) having an average diameter of from 20 μm to 70 μm are adhered to the surface of a highly-rigid roller, at a distribution density of from 20% to 80% with respect to the area of the surface of the roller. Details of the method are described in JP-A No. 2001-72274, at paragraph numbers of from [0058] to [0063].

As the metal roller described above, a feed roller comprised of a highly rigid roller onto which wear-resistant particles are adhered (for example, a roller installed in a printer (PM-G800 (trade name), Lot No. C55101005NA04702276, manufactured by Seiko Epson Corp.), or a roller having a design equivalent to such a feed roller may be used.

Further, as the wear-resistant particles to be adhered to the surface of the highly-rigid roller, for example, particles of ceramics such as alumina, silicon carbide and the like are preferable, from the viewpoint of a close affinity with the back surface of an inkjet recording medium, and an increased accuracy of sheet feeding at high speed.

The static friction coefficient A between the surface of the highly rigid roller and the back surface of the recording medium can be adjusted, for example, by appropriately selecting the surface condition of the roller and/or the type or amount of constituent components of the back surface, the degree of surface unevenness or the like.

Further, in the invention, as stipulated in item (2) above, an amount of deformation B [μm] of the overall layers provided on the back coat layer side of the support satisfies the range of 32>B>20. Here, the amount of the deformation refers to the amount of deformation of the layer caused by pushing-in (intrusion) of the wear-resistant particles adhered onto the surface of the feed roller into the back surface of an inkjet recording medium. When the amount of deformation due to intrusion is less than 20 μm, the feed roller may slip and fail to properly grip the back surface of the inkjet recording medium. In contrast, when the amount of deformation due to intrusion exceeds 32 μm, the wear-resistant particles may be embedded in the back surface of the inkjet recording medium, which may reduce the accuracy of sheet feeding. These are closely related to a thickness and physical properties of a resin to be coated on the back surface. Namely, properties required for a resin contained in the back coat layer provided on the back surface of the recording medium are important, and the resin preferably has a glass transition temperature (Tg) of from 0° C. to less than 120° C., and a thickness in the range of from 1.5 μm to 20 μm.

The amount of deformation due to pushing-in (intrusion) can be measured as a maximum deformation amount using a push-in tester (Thermomechanical Analyzer TMA Q400 TA (trade name), manufactured by TA Instruments Inc.) at a measurement temperature of 25° C., by conducting a loading/unloading measurement at 0.1 to 1 N and 1 to 0.1 N, respectively, at a loading velocity of 0.1 N/minute with a zirconia press probe having a diameter of 3 mm.

Further, in the invention, as stipulated in item (2) above, the rigidity C [mN·m] of "the overall layers including the support, the ink receiving layer and the back coat layer", i.e., the rigidity of the whole inkjet recording medium as measured in accordance with JIS P 8125 satisfies the range of 5>C>2. Here, the rigidity is a value that indicates the rigidity (stiffness) of a recording medium, and is measured in accordance with JIS P 8125. The rigidity can be measured by TABER TYPE STIFFNESS TESTER (trade name, manufactured by Toyo Seiki Seisaku-sho Ltd.) as a measurement instrument.

When the rigidity of an inkjet recording medium is 2 or less, it is not preferable since a hand touch high-quality feeling is impaired, and when the rigidity 5 or more, it is not preferable since banding may occur when an image is formed on the inkjet recording medium in a printer.

The rigidity of the inkjet recording medium can be adjusted, for example, by appropriately selecting the constituent components (for example, the type or amount of inorganic fine particles, and the type or amount of water-soluble resins), thickness or number of the ink receiving layer; the constituent components (for example, the type or amount of resins) or the thickness of the back coat layer; the type or thickness of the support; the type or thickness of the resin for coating both surfaces, or the like.

Next, in the invention, as stipulated in item (3) above, the back coat layer contains at least a resin having a stress at break of from 30 to 100 MPa, and an elongation at break of from 2 to 40% GL as measured in accordance with JIS K 7161. In order to enhance a gripping force between the feed roller and the back surface of the inkjet recording medium, it is important that the wear-resistant particles fixed on the feed roller that have intruded into the resin of the back surface can maintain their gripping force to a strong level, while the roller is rotated at high speed. Namely, the stress at break of the resin for the back coat layer is determined to be from 30 to 100 MPa. When the stress at break is less than 30 MPa, the resin may become fragile or susceptible to elongation, and when the stress at break exceeds 100 MPa, the wear-resistant particles may not readily intrude into the back surface of the inkjet recording medium, and thus the gripping force may decrease. Similarly, from the viewpoint of the gripping force, the resin is preferably not excessively stretchable and its elongation at break is preferably in the range of from 2 to 40% GL. If the elongation at break is less than 2% GL, wear-resistant particles may not readily intrude into the resin, or the resin may become fragile, and there is a fear that the gripping force may decrease. In contrast, if the elongation at break exceeds 40% GL, the resin may become susceptible to elongation, thereby decreasing the gripping force.

The stress at break and the elongation at break of a resin can be measured in accordance with JIS J 7161. As a measuring apparatus, TENSILON (Model RTM-50) (trade name: manufactured by Orientec Co., Ltd) can be used.

Details of the resins having the above ranges of the stress at break and the elongation at break will be described later. The back coat layer is formed by appropriately selecting the resin to be used in consideration of the type or content ratio thereof.

Next, details of the ink receiving layer, back coat layer, support and the like that constitute the inkjet recording medium of the invention will be provided.

—Ink Receiving Layer—

The ink receiving layer that constitutes the inkjet recording medium (hereinafter, sometimes referred to as a "front-side ink receiving layer") contains at least fine particles and a water-soluble resin, and optionally contains other components such as a crosslinking agent, a mordant, a water-soluble polyvalent metal salt compound and a cation-modified polymer latex.

The ink receiving layers may be provided on one surface of a support by an amount of one or more. The ink receiving layer is a recording layer for recording a high quality image known as a photo-like image. The side of an inkjet recording medium on which an ink receiving layer is provided corresponds to the front surface of the inkjet recording medium. The ink receiving layer may also be provided on a later-described back coat layer that is provided on an opposite side to the front surface, as well as on the front surface.

(Fine Particles)

The ink receiving layer of the ink jet recording medium of the invention contains at least one kind of fine particles. By containing the fine particles, the ink receiving layer can acquire a porous structure, and by which ink absorbing performance can be improved. In particular, when the solid content of fine particles in the ink receiving layer is 50% by mass or more, more preferably more than 60% by mass, it is preferable since an even superior porous structure can be formed and an ink jet recording medium having a sufficient ink absorbing property can be obtained.

The solid content of fine particles in the ink receiving layer herein is calculated based on the components except water or other solvents in the composition constituting the ink receiving layer.

While the fine particles used in the invention are preferably inorganic fine particles, organic fine particles may be used so long as the particles do not impair the effect of the invention.

Preferable organic fine particles include polymer fine particles obtained by emulsion polymerization, micro-emulsion polymerization, soap-free polymerization, seed polymerization, dispersion polymerization, suspension polymerization, or the like: for example, polymer fine particles in the form of powder, latex, emulsion or the like of polyethylene, polypropylene, polystyrene, polyacrylate, polyamide, silicone resin, phenol resin, natural polymer or the like.

When organic fine particles are used, they are preferably cationized and, since the organic fine particles mainly constitute a porous column material, the organic fine particles preferably has no film forming property or in a small amount, if any, and preferably has a minimum film forming temperature (MFT) of 50° C. or more, more preferably 120° C. or more.

Examples of the inorganic fine particles include those of silica, colloidal silica, titanium dioxide, barium sulfate, calcium silicate, zeolite, kaolinite, halloysite, mica, talc, calcium carbonate, magnesium carbonate, calcium sulfate, pseudo-boehmite, zinc oxide, zinc hydroxide, alumina, aluminum silicate, calcium silicate, magnesium silicate, zirconium oxide, zirconium hydroxide, cerium oxide, lanthanum oxide, and yttrium oxide. Among these, silica fine particles, colloidal silica, alumina fine particles and pseudo-boehmite are preferable from the viewpoint of forming a favorable porous structure.

The fine particles may be used as primary particles, or in the form of secondary particles. The average primary particle diameter of the fine particles is preferably 2 μm or less, and more preferably 200 μm or less.

Furthermore, silica fine particles with an average primary particle diameter of 20 nm or less, colloidal silica with an average primary particle diameter of 30 nm or less, alumina fine particles with an average primary particle diameter of 20 nm or less, and pseudo-boehmite with an average fine pore diameter of 2 to 15 nm are more preferable, and silica fine particles, alumina fine particles and pseudo-boehmite are particularly preferable.

The silica fine particles are roughly classified into particles produced by a wet method and particles produced by a diy method (gas phase method). In the wet method, typically, active silica that has been formed by acidolysis of a silicate salt is appropriately polymerized, followed by coagulation and precipitation, thereby forming hydrated silica. In contrast, in a gas-phase method, anhydrous silica is typically obtained by hydrolysis of silicon halide in a gas phase at a high temperature (flame hydrolysis method), or by heating silica sand and coke to cause reduction and vaporization thereof with arc in an electric furnace, and then oxidizing the product with air (arc method). The "gas phase silica" or "famed silica" means anhydrous silica fine particles obtained by a gas phase method. The silica fine particles used in the invention are particularly preferably fumed silica particles.

Fumed silica exhibits different properties from those of hydrated silica due to differences in the density of silanol groups on the surface, presence or absence of voids, and is suitable for forming a three-dimensional structure with a high void ratio. While the reason thereof is not clear, it is presumed that the density of the silanol groups on the surface of the fine particles is as large as 5 to 8/nm$^2$ in hydrated silica, which makes silica particles readily aggregate. In contrast, the density of the silanol group on the surface of the fine particles is as small as 2 to 3/nm$^2$ in fumed silica, which leads to formation of coarse and soft flocculates, resulting in a structure with a high void ratio.

Since fumed silica has a particularly high specific surface area, efficiency of absorbing and retaining ink is high. In addition, due to its low refractive index, transparency can be imparted to the ink receiving layer and a high color density and favorable coloring property can be obtained by performing dispersion of the particles until they have a proper particle diameter. It is important that the ink receiving layer is transparent not only in applications where being transparent is required, such as an OHP film, but also in applications as a recording sheet such as a photographic glossy paper sheet, in order to obtain a high color density and a favorable glossiness of colors.

The average primary particle diameter of fumed silica is preferably 1 to 30 nm, more preferably 1 to 20 nm, particularly preferably 1 to 10 nm, and most preferably 3 to 10 nm. Since fumed silica particles are liable to bond to each other via a hydrogen bond between the silanol groups, a structure having a large void ratio can be formed and ink absorbing characteristics may be effectively improved, when the average primary particle diameter is 30 nm or less.

The silica fine particles may be used together with other fine particles. In this case, the content of fumed silica is preferably 30% by mass or more, and is more preferably 50% by mass or more.

Alumina fine particles, alumina hydrate, and a mixture or composite thereof are also preferable as the inorganic fine particles used in the invention. The alumina hydrate is preferable among them since it favorably absorbs and fixes ink, and pseudo-boehmite ($Al_2O_3 \cdot nH_2O$) is particularly preferable. While various forms of alumina hydrate are applicable, boehmite sol is preferably used as a raw material since it readily forms a smooth surface.

The fine void structure of pseudo-boehmite has an average fine void diameter of preferably 1 to 30 nm, and has more preferably 2 to 15 nm. The fine void volume is preferably 0.3 to 2.0 cc/g, and is more preferably 0.5 to 1.5 cc/g. The fine void diameter and fine void volume can be measured by a nitrogen absorption-desorption method using, for example, a gas absorption-desorption analyzer (for example, Omnisorp 369 manufactured by Beckman Coulter, Inc.).

Among the alumina fine particles, humed alumina fine particles are preferable for its high specific surface area. The average primary particle diameter of fumed alumina is preferably 30 nm or less, and is more preferably 20 nm or less.

When colloidal silica or titanium dioxide is used, there is a possibility that sufficient void ratio may not be obtained due to their small ability of void forming. However, it is effective to apply a method of including silica fine particles and colloidal silica in the same layer or a method of superposing a layer containing colloidal silica and a layer containing titanium dioxide, or the like, in order to exert the effect of the invention.

The fine particles may be subjected to a surface treatment with a silane coupling agent. As the silane coupling agent, those having organic functional group (such as a vinyl group, amino group (primary to tertiary amino groups, quaternary ammonium salt group), epoxy group, mercapto group, chloro group, alkyl group, phenyl group and ester group) are preferably used.

In employing the above-mentioned fine particles in an inkjet recording medium, embodiments disclosed in JP-A Nos. 10-81064, 10-119423, 10-157277, 10-217601, 11-348409, 2001-138621, 2000-43401, 2000-211235, 2000-309157, 2001-96897, 2001-138627, 11-91242, 8-2087, 8-2090, 8-2091, 8-2093, 8-174992, 11-192777 and 2001-301314 are also preferably used.

(Water Soluble Resin)

The ink jet recording medium of the invention contains at least one water soluble resin in the ink receiving layer.

Examples of the water soluble resin include polyvinyl alcohol resins having hydroxyl groups as a hydrophilic structural unit (for example, polyvinyl alcohol (PVA), acetoacetyl-modified polyvinyl alcohol, cation-modified polyvinyl alcohol, anion-modified polyvinyl alcohol, silanol-modified polyvinyl alcohol and polyvinyl acetal), cellulose resins (methyl cellulose (MC), ethyl cellulose (EC), hydroxyethyl cellulose (HEC), carboxymethyl cellulose (CMC), hydroxypropyl cellulose (HPC), hydroxyethylmethyl cellulose and hydroxypropylmethyl cellulose), chitins, chitosans, starch, resins having ether bonds (polyethylene oxide (PEO), polypropylene oxide (PPO), polyethyleneglycol (PEG) and polyvinyl ether (PVE)), resins having carbamoyl groups (polyacrylamide (PAAM), polyvinyl pyrrolidone (PVP) and polyacrylic acid hydrazide).

Those having carboxylic groups as dissociation groups, such as polyacrylic acid salts, maleic acid resins, alginic acid salts and gelatin, may also be mentioned.

Among the above polymers, polyvinyl alcohol resins are particularly preferable. Examples of the polyvinyl alcohol resins are described in Japanese Patent Application Publication (JP-B) Nos. 4-52786, 5-67432 and 7-29479, Japanese Patent No. 2537827, JP-B No. 7-57553, Japanese Patent Nos. 2502998 and 3053231, JP-A No. 63-176173, Japanese Patent No. 2604367, JP-A Nos. 7-276787, 9-207425, 11-58941, 2000-135858, 2001-205924, 2001-287444, 62-278080 and 9-39373, Japanese Patent No. 2750433, JP-ANos. 2000-158801, 2001-213045, 2001-328345, 8-324105 and 11-348417.

Compounds described in paragraphs [0011] to [0014] in JP-A No. 11-165461 may also be mentioned as examples of water soluble resins other than polyvinyl alcohol resins.

These water soluble resins may be used alone, or in a combination of two or more of them.

The content of the water soluble resin of the invention is preferably 9 to 40% by mass and is more preferably 12 to 33% by mass, with respect to the total solid content of the ink receiving layer.

The water soluble resin and fine particles that mainly constitute the ink receiving layer of the invention may be comprised of a single material, or may be a mixed material of plural materials, respectively.

From the viewpoint of maintaining transparency, the type of the water soluble resin to be combined with fine particles, particularly with silica fine particles, is important. Polyvinyl alcohol is preferable as the water soluble resin when fumed silica is used. Among these, polyvinyl alcohol with a saponification degree of from 70 to 100% is preferable, and polyvinyl alcohol with a saponification degree of 80 to 99.5% is particularly preferable.

Moreover, from the viewpoint of maintaining image density or preventing curling of a recording medium toward the ink receiving layer side, polyvinyl alcohol with a saponification degree of 75 to 95% is preferable, and polyvinyl alcohol with a saponification degree of 80 to 90% is particularly preferable.

The polymerization degree of polyvinyl alcohol is preferably from 1400 to 1500, and is more preferably from 2300 to 4000, from the viewpoint of obtaining sufficient film strength. Polyvinyl alcohols with a polymerization degree of less than 1400 and with a polymerization degree of 1400 or more may be used in combination.

The above-mentioned polyvinyl alcohol resins, having hydroxyl groups in its structural unit that form hydrogen bonds with silanol groups on the surface of silica fine particles, facilitate formation of a three dimensional network structure in which secondary particles of the silica fine particles serve as a network chain unit. It is presumed that by the formation of such a three dimensional network structure, an ink receiving layer having a porous structure with a high void ratio and sufficient strength is formed.

In inkjet recording, the porous ink receiving layer obtained as described above rapidly absorbs ink by its capillary action, and forms favorable dots having a high degree of circularity that do not cause ink bleeding.

The polyvinyl alcohol resin may be used in combination with other types of water soluble resins as mentioned above. When the other water soluble resin is used with the polyvinyl alcohol resin, the content of the polyvinyl alcohol resin in the total water soluble resins is preferably 50% by mass or more, and is more preferably 70% by mass or more.

When a cation-modified polymer latex as described later having a glass transition temperature (Tg) of 40° C. or less is used, it is preferable that polyvinyl alcohol having an acetoacetic acid ester group is at least partly used, from the viewpoint of increasing the strength of the ink receiving layer. When using the polyvinyl alcohol having an acetoacetic acid ester group, a crosslinking agent described in JP-A Nos. 2004-277367, 2004-268576, 2004-168853, 2004-83756 or 2003-301084 is preferably used in combination. Among these, compounds containing zirconium such as ammonium zirconium acetate and ammonium zirconium carbonate are preferable from the viewpoint of increasing the strength of the ink receiving layer.

<Composition Ratio of Fine Particles and Water Soluble Resin>

The mass composition ratio (PB ratio (x/y)) of fine particles (x) and a water soluble resin (y) largely affect the structure and strength of the ink receiving layer. As the mass composition ratio (PB ratio) increases, the void ratio, fine void volume and surface area (per unit mass) tend to increase: however, the density and strength tend to decrease.

The mass composition ratio (PB ratio, (x/y)) of the ink receiving layer of the invention is preferably 1.5 to 10, in view of preventing reduction in the layer strength and occurrence of cracks caused by drying due to too large PB ratio, and preventing reduction in ink absorbing ability due to blocking of voids with the resin and reduction in the void ratio due to too small PB ratio.

Since a strain may be applied on a recording sheet when the recording sheet is conveyed in a conveyer system of an ink jet printer, it is necessary that the ink receiving layer has a sufficient film strength. Further, it is necessary that the ink receiving layer has a sufficient strength also in view of preventing cracks and peeling of the ink receiving layer when cutting or processing the recording sheet. In view of the above, the mass ratio (x/y) is more preferably 5 or less, and from the viewpoint of securing an ability of rapidly absorbing ink in an inkjet printer, the mass ratio is more preferably 2 or more.

For example, when a layer is formed by coating a substrate with a liquid containing silica fine particles with an average primary diameter of 20 nm or less and a water soluble resin that are completely dispersed in water at a mass ratio (x/y) of 2 to 5 and drying it, a three-dimensional network structure including network chains of secondary particles of the silica fine particles is formed. In this way, a light-permeable porous layer with an average fine void diameter of 30 nm or less, a void ratio of 50% to 80%, a specific void volume of 0.5 ml/g or more, and a specific surface area of 100 $m^2/g$ or more can be readily formed.

(Cross-Linking Agent)

The ink receiving layer of the invention preferably is a layer containing fine particles and a water soluble resin, and further a cross-linking agent that can cross-link at least the water soluble resin, and is preferably a porous layer obtained by curing the coated layer by a cross-linking reaction between the fine particles and the cross-linking agent.

Boron compounds are preferably used for cross-linking of the water soluble resin, particularly a polyvinyl alcohol resin. Examples of the boron compound include borax, boric acid, borate (for example orthoborate, $InBO_3$, $ScBO_3$, $YBO_3$, $LaBO_3$, $Mg_3(BO_3)_2$ and $CO_3(BO_3)_2$), diborate (for example $Mg_2B_2O_5$, $CO_2B_2O_5$), methaborate (for example $LiBO_2$, $Ca(BO_2)_2$, $NaBO_2$ and $KBO_2$), tetraborate (for example $Na_2B_4O_7 \cdot 10H_2O$), and pentaborate (for example $KB_5O_8 \cdot 4H_2O$, $Ca_2B_6O_{11} \cdot 7H_2O$, and $CsB_5O_5$). Among these, in view of causing a rapid cross-linking reaction, borax, boric acids and borates are preferable, and boric acid is particularly preferable.

The following compounds other than the boron compounds may be used as the cross-linking agent of the water soluble resin.

The compounds are, for example, aldehyde compounds such as formaldehyde, glyoxal and glutaraldehyde; ketone compounds such as diacetyl and cyclopentanedione; active halogen compounds such as bis(2-chloroethylurea)-2-hydroxy-4,6-dichloro-1,3,5-triazine, 2,4-dichloro-6-triazine sodium salt; active vinyl compounds such as divinyl sulfonic acid, 1,3-divinylsulfonyl-2-propanol, N,N'-ethylenebis(vinylsulfonylacetamide), and 1,3,5-triaclyroyl-hexahydro-5-triazine; N-methylol compounds such as dimethylol urea, and methylol dimethylhydantoin; melamine resins (for example methylolmelamine, alkylated methylolmelamine; and epoxy resins.

Examples of the preferable cross-linking agent include isocyanate compounds such as 1,6-hexamethylene diisocyanate; aziridine compounds described in U.S. Pat. Nos. 3,017,280 and 2,983,611; carboxylmide compounds described in U.S. Pat. No. 3,100,704; epoxy compounds such as glycerol triglycidyl ether; ethylene imino compounds such as 1,6-hexamethylene-N,N'-bisethylene urea; halogenated carboxyaldehyde compounds such as mucochloric acid and mucophenoxy chloric acid; dioxane compounds such as 2,3-dihydroxydioxane, metal-containing compounds such as titanium lactate, aluminum sulfate, chromium alum, potassium alum, zirconyl acetate and chromium acetate; polyamine compounds such as tetraethylenepentamine; hydrazide compounds such as hydrazine adipate; and low molecular weight compounds or polymers containing at least two oxazoline groups.

The above mentioned cross-linking agents may be used alone, or in combination of two or more.

Preferably, the cross-linking and curing of the coated layer is performed by adding a cross-linking agent to at least one of a coating liquid containing fine particles, a water soluble resin and the like (sometimes referred to as "coating liquid A" hereinafter), and a basic solution that will be described later, and by applying a basic solution having a pH of 7.1 or more (sometimes referred to as "coating liquid B" hereinafter) to the coated layer either: (1) substantially simultaneously with the formation of the coated 1 by applying the coating liquid; or (2) during drying the coated layer formed by applying the coating liquid and before the coated layer exhibits a decreasing rate of drying. A boron compound used as a cross-linking agent may be contained in either coating liquid A or coating liquid B, or in both of them.

The amount of use of the cross-linking agent with respect to the above-mentioned aqueous solution is preferably 1% to 50% by mass, and is more preferably 5% to 40% by mass.

(Other Components)

The ink receiving layer of the invention may contain other components such as a mordant, a water soluble polyvalent metal salt compound, a cation-modified polymer latex or the like, in addition to the above-mentioned fine particles and water soluble resin.

As a mordant, a cationic polymer (cationic mordant) as an organic mordant, or an inorganic mordant is preferably used. The organic or inorganic mordant may be used singly or in combination.

As the water soluble polyvalent metal salt compound, those of metals such as calcium, barium, manganese, cupper, cobalt, nickel, aluminum, iron, zinc, zirconium, chromium, magnesium, tungsten, molybdenum can be mentioned. The water soluble polyvalent metal salt compound can suppress bleeding in an image that occurs with time (moisture resistance in a high-humidity environment), and is also effective to improve gas-resistant and light-resistant properties.

The cation-modified polymer latex is a product prepared by emulsification or dispersion of a non-water soluble polymer into the form of a colloid dispersion with a particle diameter of from 0.001 to 0.1 μm, or an emulsion with a particle diameter of 0.2 μm or more, and examples thereof include latexes of polystyrene-type, styrene-butadiene copolymer-type, acrylonitrile-butadiene-type, acrylic acid-type, styrene-acrylic acid-type, urethane-type, methacrylic acid-type, vinyl chloride-type, vinyl acetate-type, ethylene-vinyl acetate type, and the like. Containing a cation-modified polymer latex is effective in improving the strength of the ink receiving layer, preventing scratches at the surface of the ink receiving layer formed at the time of conducting inkjet recording, and improving the moisture resistance of an image after being recorded (preventing bleeding of ink due to moisture and heat).

As the aforementioned components other than fine particles and a water soluble resin, such as a mordant, water-soluble polyvalent metal salt compound, cation-modified polymer latex, for example, components described in JP-A No. 2006-334911, paragraphs [0086] to [0161] can be appropriately selected and used.

—Back Coat Layer—

The back coat layer that constitutes the inkjet recording medium of the invention is provided on an opposite side of the support to the side of the aforementioned front-side ink receiving layer. The back coat layer contains at least a resin, and may contain other components as necessary.

The resin used in the back coat layer has a stress at break as measured in accordance with JIS K 7161 of from 30 to 100 MPa and an elongation at break of from 2 to 40% GL, and further satisfies the aforementioned requirements (2) and (3) for the inkjet recording medium of the invention.

Examples of the resin that may contained in the back coat layer include aqueous binders. For example, water soluble polymers such as styrene-maleic acid copolymers, styrene-acrylate copolymers, polyvinyl alcohol, silanol-modified polyvinyl alcohol, starch, cationized starch, casein, gelatin, carboxymethyl cellulose, hydroxyethyl cellulose, polyvinyl pyrrolidone and the like, water dispersible polymers such as styrene-butadiene latex, acrylic emulsion, urethane-based ionomer, urethane-based emulsion, and the like, can be mentioned.

Among these, in view of water resistance or film formation properties, styrene-maleate copolymers, styrene-acrylate copolymers, styrene-butadiene latex, acrylic emulsion, and urethane-based emulsion are preferable.

As a component that can be added to the back coat layer include a white pigment and other components.

Examples of the white pigment that can be contained in the back coat layer include inorganic white pigments such as light calcium carbonate, heavy calcium carbonate, kaolin, talc, calcium sulfate, barium sulfate, titanium dioxide, zinc oxide, zinc sulfate, satin white, aluminum silicate, diatom earth, calcium silicate, magnesium silicate, synthetic amorphous silica, colloidal silica, colloidal alumina, pseudo-boehmite, aluminum hydroxide, alumina, lithopone, zeolite, hydrous halloysite, magnesium carbonate, magnesium hydroxide and the like, organic pigments such as styrene-based plastic pigments, acrylic-based plastic pigments, polyethylene, microcapsules, urea resins, melamine resins, and the like.

Other components that can be contained in the back coat layer include antifoaming agents, dyes, fluorescent brightening agents, antiseptic agents, waterproofing agents, and the like.

The thickness of the back coat layer is preferably 3 to 18 μm, and is more preferably 5 to 15 μm, in view of a static friction coefficient with a metal roller and a push-in deformation amount.

—Substrate—

As the support for the inkjet recording medium of the invention, either a transparent substrate made of transparent materials such as plastics, or an opaque substrate made of opaque materials such as paper may be used as the substrate of the invention. In order to take advantage of transparency of the ink receiving layer, a transparent substrate or a highly glossy opaque substrate is preferably used.

The material used for the transparent substrate is preferably transparent and resistant to radiant heat in order to cope with the use in an OHP or backlight display. The preferable materials thereof include polyesters such as polyethylene terephthalate (PET), polysulfone, polyphenylene oxide, polyimide, polycarbonate and polyamide. Among these, polyesters are preferable, and polyethylene terephthalate is particularly preferable.

The thickness of the substrate is not particularly restricted, but is preferably 50 to 200 μm from the viewpoint of handleability.

The opaque substrate having a high glossiness preferably has a glossiness of 40% or more at the surface on which an ink receiving layer is provided. The glossiness is measured according to JIS P-8142 (75 degree mirror surface glossiness test method of paper sheets and paper boards). Specific examples of the substrate are as follows.

Highly glossy paper substrates such as art paper, coat paper, cast-coat paper, and barite paper used for silver salt photographic substrate; highly glossy films containing a white pigment or the like to be opaque, for example, those made of polyesters such as polyethylene terephthalate (PET), cellulose esters such as nitrocellulose, cellulose acetate and cellulose acetate butylate, polysulfone, polyphenylene oxide, polyimide, polycarbonate and polyamide (these may be subjected to a surface calendar treatment); and substrates comprised of the aforementioned paper substrates, transparent substrates and highly glossy films containing a white pigment on which a polyolefin coating layer that may contain a white pigment is provided.

Foamed polyester films containing a white pigment (for example, foamed PET film containing polyolefin fine particles and voids formed by stretching the film) are also favorably used. Resin coat paper used for silver salt photographic printing is also favorably used.

The thickness of the opaque substrate is also not particularly restricted, but is preferably 50 to 300 μm in view of handleability.

Substrates that have been subjected to a corona discharge treatment, glow discharge treatment, flame treatment or UV irradiation treatment on the surface in order to improve wettability and adhesive property may also be used.

The raw paper sheet used for resin coat paper will be described in detail below.

The raw paper is produced from wood pulp as a main raw material, and is formed into a sheet with the addition of a synthetic pulp such as polypropylene pulp, or synthetic fibers such as nylon or polyester fibers, as necessary. Any one of LBKP, LBSP, NBKP, NBSP, LDP, NDP, LUKP and NUKP may be used as the wood pulp, but it is preferable that LBKP, NBSP, LBSP, NDP or LDP containing more short fibers is used in large amounts.

The proportion of LBS and/or LDP is preferably 10% by mass to 70% by mass.

Chemical pulps (sulfate pulp and sulfite pulp) containing few impurities are preferably used, and the pulp having been subjected a bleaching treatment to improve its brightness is also useful.

Sizing agents such as a higher fatty acid and alkylketene dimer, white pigments such as calcium carbonate, talc and titanium oxide, paper strength enhancers such as starch, polyacrylamide and polyvinyl alcohol, fluorescent brighteners, humectants such as polyethyleneglycol, dispersing agents, softening agents such as quaternary ammonium, and the like may be appropriately added in the raw paper sheet.

The degree of water filtration of the pulp used is 200 to 500 ml as defined in CFS. The fiber length after beating is defined as a value measured by a sieve classification method according to JIS P-8207, and the sum of the percentage by mass of the 24 mesh filtration residue and the percentage by mass of the 42 mesh filtration residue is preferably 30 to 70% by mass.

The percentage by mass of the 4 mesh filtration residue is preferably 20% by mass or less.

The average weight of the raw paper sheet is preferably 30 to 270 g/m$^2$, and is particularly preferably 50 to 240 g/m$^2$. The thickness of the raw paper is preferably 40 to 240 μm. The raw paper sheet may be subjected to a calender treatment during a paper making process or subsequent processes to impart a high smoothness. The density of the raw paper is usually 0.7 to 1.2 g/m$^2$ (JIS P-8118).

The rigidity of the raw paper is preferably 20 to 200 g under the condition according to JIS P-8143.

A surface sizing agent may be applied on the surface of the raw paper sheet, and the same sizing agent as those that can be added in the raw paper sheet may be used as the surface sizing agent.

The pH of the raw paper sheet is preferably 5 to 9 as measured by a hot water extraction method according to JIS P-8113.

The polyethylene used for coating the front and back surfaces of the raw paper sheet is mainly low density polyethylene (LDPE) and/or high density polyethylene (HDPE), but other LLDPEs, polypropylene and the like may be partly used.

Titanium oxide of rutile- or anatase-type, a fluorescent brightening agent or ultramarine blue is preferably added into the polyethylene layer that forms the ink receiving layer to improve its opaqueness, whiteness and hue, as widely adopted in photographic printing paper sheets. The content of titanium oxide is preferably 3 to 20% by mass, more preferably 4 to 13% by mass, with respect to the amount of polyethylene. The thickness of the polyethylene layer is not particularly restricted, but is preferably 10 to 50 μm for both of the top and back surface layers. An undercoat layer may be provided on the polyethylene layer to endow the polyethylene layer with an adhesive property to the ink receiving layer. Aqueous polyester, gelatin and PVA are preferably used as the undercoat layer. The thickness of the undercoat layer is preferably 0.01 to 5 μm.

The polyethylene coated paper sheet may be used as glossy paper, or with a matte surface formed thereon by performing an embossing treatment when polyethylene is coated on the raw paper sheet by melt-extrusion, as with usual photographic printing paper sheets.

The inkjet recording medium of the invention can be produced by forming at least one ink receiving layer on one side (front side) of a support, and forming a back coat layer and, as necessary, an inc receiving layer on the other side (back side) of the support.

The method of producing the inkjet recording medium of the invention is not particularly limited, but may be appropriately selected from those described in JP-A No. 2006-334911, paragraphs [0179] to [0227], and the like.

<Inkjet Recording Method>

The inkjet recording method of the present invention includes applying ink onto an ink receiving layer of an inkjet recording medium including a support, at least one ink receiving layer formed on one surface of the support containing at least fine particles and a water-soluble resin, and a back coat layer that is formed on the other surface of the support, the back coat layer containing a resin having a stress at break of from 30 to 100 MPa and an elongation at break of from 2 to 40% GL, wherein a static friction coefficient between an uppermost surface of the ink receiving layer side of the support and the uppermost surface of the back coat layer side of the support is in the range of from 0.46 to 0.77.

The inkjet recording method of the present invention is carried out in order to satisfy the equation: $B>-30A+4C+37$.

In the above equation, A is a static friction coefficient between the uppermost surface at the back coat layer side of the support and a feed roller of an inkjet printer formed from a highly-rigid roller onto which wear-resistant particles are adhered; B is an amount of deformation of the overall layer(s) on the back coat layer side of the support measured in (μm); and C is an overall rigidity of the layers including the support, the ink receiving layer and the back coat layer (mN·m), wherein A, B and C are within the ranges of $0.84>A>0.44$, $32>B>20$ and $5>C>2$, respectively.

Details of the inorganic fine particles, water soluble resin and the ink receiving layer containing the same, the resin and the back coat layer containing the same, the support, and the static friction coefficient and formula (I) are as described above, and preferable embodiments thereof are also the same.

The inkjet recording method of the invention, employing the above structure, is applicable to high-speed recording, accurate in high-speed conveyance, and capable of recording a high-quality image with no image defects such as banding or white spots at high speed.

EXAMPLES

Hereinafter, the invention will be further described in detail with reference to the following examples, but the invention is not limited to these examples. Hereinafter, in the examples, inkjet recording sheets will be taken as examples of the inkjet recording media in order to provide detailed explanation. The units represented by "part" and "%" are based on mass unless otherwise specified.

Example 1 —Preparation of Support—

50 parts of LBKP made from acacia and 50 parts of LBKP made from aspen were beaten by a disc refiner to have a Canadian Freeness of 300 ml, respectively, thereby forming a pulp slurry.

Next, to the obtained pulp slurry were added 1.3% of cation-modified starch (CAT0304L (trade name) manufactured by Nippon NSC Ltd.), 0.15% of an anionic polyacrylamide (DA4104 (trade name) manufactured by Seiko PMC Corporation), 0.29% of an alkylketene dimmer (SIZE PINE K (trade name) manufactured by Arakawa Chemical Industries Ltd.), 0.29% of epoxydated behenic acid amide and 0.32% of polyamidepolyamine epichlorohydrin (ARAFIX 100 (trade name) manufactured by Arakawa Chemical Industries Ltd.), with respect to the pulp. Then, 0.12% of a defoaming agent was added thereto.

Thereafter, the pulp slurry was subjected to paper-making by use of a fourdrinier machine and was dried through a process in which a felt surface of a web was pressed against a drum drier cylinder via a drier canvas with a tensile force of the drier canvas set at 1.6 kg/cm. Subsequently, both sides of the resultant were coated with polyvinyl alcohol (KL-118 (trade name) manufactured by Kuraray Co., Ltd.) by size pressing at an amount of 1 g/m$^2$, and dried, followed by a calender treatment. The obtained base paper (substrate paper) had a weight of 208 g/m$^2$ and a thickness of 200 μm.

After subjecting a wire side (back side) of the obtained substrate paper to a corona discharge treatment, this was coated with a resin composition with a formulation of a high density polyethylene with a melt flow rate (MFR) of 16.0 g/10 min. and a density of 0.96 g/cm$^3$ (containing 250 ppm of hydrotalcite (DHT-4A (trade name) manufactured by Kyowa Chemical Industry Co., Ltd.) and 200 ppm of a secondary antioxidant (tris(2,4-di-t-butylphenyl)phosphite, IRGAFOS 168 (trade name) manufactured by Ciba Specialty Chemicals Co., Ltd.)) and a low density polyethylene with a melt flow rate (MFR) of 4.0 g/10 min. and a density of 0.93 g/cm$^3$ at a mass ratio of 75/25 (high density polyethylene/low density polyethylene) to a thickness of 36.5 g/m$^2$ by a melt extrusion coater, thereby forming a thermoplastic resin layer A with a matte surface.

Thereafter, a surface of the thermoplastic resin layer A formed on the backside of the substrate paper was further subjected to a corona discharge treatment, and a backside coating liquid having the composition as shown below was applied thereon with an application amount of 203 ml/m$^2$. In the following, the surface onto which the backside coating liquid was applied corresponds to the uppermost surface of the backside of an inkjet recording sheet (hereinafter, the uppermost surface of the backside is referred to as "back surface").

Subsequently, a surface opposite to the aforementioned back surface of the support was subjected to a corona discharge treatment, and was coated with a low density polyethylene with a melt flow rate (MFR) of 4.0 g/10 min. and a density of 0.93 g/cm$^3$ containing 10% of titanium oxide by a melt extrusion coater, thereby forming a thermoplastic resin layer B with a mirror surface. In the following, the surface of the thermoplastic resin layer B corresponds to the uppermost surface of the front side of an inkjet recording sheet (hereinafter, the uppermost surface of the front side is referred to as "front surface").

As described above, a support having both sides coated with a resin (resin coated paper) was obtained.

—Preparation of Backside Coating Liquid—

A backside coating liquid was prepared by mixing the following components.

| <Composition of backside coating liquid> | |
|---|---|
| (1) Polyvinyl alcohol (water-soluble resin) (PVA 235 (trade name), saponification degree: 88%, polymerization degree: 3,500, manufactured by Kuraray Co., Ltd) | 3.5 parts by solid |
| (2) Polyoxyethylene lauryl ether (surfactant) (EMULGEN 109P (trade name). 10% aqueous solution, HLB value: 13.6, manufactured by Kao Corporation) | 0.83 parts |
| (3) Ion exchange water | 95.7 parts |

—Preparation of Inorganic Fine Particle Dispersion for Ink Receiving Layer—

The following components were mixed and dispersed by use of a non-media dispersing machine (ultrasonic dispersing machine manufactured by SMT Co., Ltd.), and was heated to 45° C. and maintained at this temperature for 20 hours, thereby preparing an inorganic fine particle dispersion for ink receiving layer.

| <Composition of dispersion> | |
|---|---|
| (1) Fumed silica (inorganic fine particles) (AEROSIL 300SF75 (trade name), manufactured by Nippon Aerosil Co., Ltd., average primary particle diameter: 7 nm) | 10.0 parts |
| (2) Ion exchange water | 62.8 parts |
| (3) SHAROL DC-902P (trade name) (51.5% aqueous solution) (dispersant, manufactured by Dai-Ichi Kogyo Seiyaku Co., Ltd.) | 0.87 parts |
| (4) ZA-30 (trade name) (zirconyl acetate, manufactured by Daiichi Kigenso Kagaku Kogyo Co., Ltd.) | 0.54 parts |

—Preparation of Coating Liquid for Ink Receiving Layer—

A coating liquid for ink receiving layer was prepared by mixing the following components.

| <Composition of coating liquid for ink receiving layer> | |
|---|---|
| (1) Inorganic fine particle dispersion for ink receiving layer | 59.5 parts |
| (2) Boric acid | 0.59 parts |
| (3) Polyvinyl alcohol (water-soluble resin) solution | 31.1 parts |
| PVA 235 (trade name) (saponification degree: 88%, polymerization degree: 3,500, manufactured by Kuraray Co., Ltd) | 2.2 parts |
| Polyoxyethylene lauryl ether (surfactant) (EMULGEN 109P (trade name), 10% aqueous solution, HLB value: 13.6, manufactured by Kao Corporation) | 0.72 parts |
| Diethyleneglycol momobutylether (BUTYCENOL 20P (trade name), manufactured by Kyowa Hakko Kogyo Co., Ltd.) | 0.66 parts |
| Ion exchange water | 27.6 parts |
| (4) Ethanol | 2.6 parts |
| (5) Ion exchange water | 4.3 parts |
| (6) SUPERFLEX 650 (trade name) (25% aqueous dispersion, manufactured by Dai-Ich Kogyo Seiyaku Co., Ltd.) | 2.2 parts |

—Composition of Basic Solution—

The following components were mixed and dissolved to form a basic solution.

| | |
|---|---|
| (1) Boric acid (crosslinking agent) | 0.65 parts |
| (2) Zirconyl ammonium carbonate (ZIRCOZOL AC-7 (trade name) (28% aqueous solution), manufactured by Daiich Kigenso Kagaku Co., Ltd.) | 2.5 parts |
| (3) Ammonium carbonate (1st grade, manufactured by Kanto Chemical Co., Inc.) | 3.5 parts |
| (4) Ion exchange water | 63.3 parts |
| (5) Polyoxyethylene lauryl ether (surfactant) (EMULGEN 109P (trade name) (2% aqueous solution), HLB value: 13.6, manufactured by Kao Corporation) | 30.0 parts |

—Preparation of Inkjet Recording Sheet—

After subjecting the front surface of the support obtained in the above to a corona discharge treatment, the coating liquid for ink receiving layer was applied thereon to an application amount of 183 ml/m$^2$ to form a layer. At this time, an 8% aqueous solution of polyaluminum chloride (ALFINE 83 (trade name), manufactured by Daimei Chemicals Co., Ltd.) was added to the coating liquid for ink receiving layer just before the application, in order that polyaluminum chloride was contained in the layer at an amount of 12.0 ml/m$^2$. Thereafter, the layer was dried with a hot-air dryer at 80° C. (air flow rate: 3 to 8 m/second) until the solid content of the layer became 20%. During this operation, the layer was dried at a constant rate. Before the drying rate of the layer exhibited a decreasing trend, the dried layer was immersed in the basic solution for 3 seconds so that the components therein were attached to the layer at an amount of 13 g/m$^2$, and the layer was further dried at 80° C. for 10 minutes. An inkjet recording sheet having an ink receiving layer with a dry thickness of 32 μm was thus obtained.

—Measurement and Evaluation—

The inkjet recording sheet prepared in the above manner was subjected to the following measurements and evaluations. The results of the measurements and evaluations are shown in Table 1 below.

(1) Static Friction Coefficient with Metal Roller

The static friction coefficient between the back surface of the inkjet recording sheet and a metal roller was measured by the following method.

By use of a feed roller comprised of a highly rigid roller onto which wear-resistant particles of ceramics such as alumina and silicon carbide (average particle diameter: 50 μm) were adhered, which was installed in a printer (PM-G800 (trade name), manufactured by Seiko Epson Corp., Lot No. C55101005NA04702276), the static friction coefficient A between the surface of the metal roller and the back surface of the inkjet recording sheet was measured in accordance with JIS P 8147. As a measuring instrument, a surface property tester (trade name: TRIBOGEAR, manufactured by Shinto Scientific Co., Ltd.) was used.

Specifically, the feed roller having a cylindrical shape was cut by a plane perpendicular to a longitude direction into 6 cm in length, and the surface (outer periphery) of the cut roller was fixed onto one surface of a stainless steel plate (6 cm square) with an adhesive, and a double-faced adhesive tape was adhered onto the entire surface of the stainless steel plate opposite to the roller side, and the stainless plate was fixed to the measuring instrument. A test piece of an A-4 size was cut out from the inkjet recording sheet, and after placing the test piece and the roller so that the back surface of the test piece was in contact with the surface of the roller, the static friction coefficient was measured at a test speed of 7 mm/minute.

(2) Push-In Deformation Amount

The amount of push-in (intrusion) deformation was determined as a maximum deformation amount after performing a loading/unloading measurement at 0.1 to 1 N and 1 to 0.1 N, respectively, at a temperature of 25° C. and a loading velocity of 0.1 N/minute, by use of a push-in tester (Thermomechanical Analyzer TMA Q400 TA (trade name), manufactured by TA Instruments Inc.) with a zirconia press probe having a diameter of 3

(3) Rigidity

The rigidity was measured by use of TABER TYPE STIFFNESS TESTER (trade name, manufactured by Toyo Seiki Seisaku-sho Ltd.) in accordance with the method described in JIS P 8125.

(4) Evaluation of Banding

An A-4 sized sheet was cut off from the inkjet recording sheet, and a gray image was uniformly printed on the ink receiving layer of the front surface of the sheet by the use of a printer capable of a high speed printing of 100 cm/second of paper feed velocity and 4.9 mm of feed length at one time. The printed image was visually evaluated in accordance with the following evaluation criteria. Here, independent ink tanks in the printer were filled with yellow, magenta, cyan, low density magenta, low density cyan, and black ink, respectively.

(Evaluation Criteria)

A: banding was not found;

B: banding was slightly visually found, and when ejected ink droplets were observed with an optical microscope with which the size of the ink droplets can be recognized, it was confirmed that overlapping of banding droplets were deviated by an amount of about 2 μm;

C: banding was slightly visually found, but was not so much as disturbing the color balance. When ejected ink droplets were observed with an optical microscope, overlapping of banding droplets were confirmed to be deviated by an amount of about 6 μm compared with the case where ink droplets were properly ejected; and D: banding was visually found, and the color balance was disturbed due to alternate occurrence of portions where ejected droplets were extremely overlapped and portions where ejected droplets were extremely missed.

Example 2

An inkjet recording sheet was prepared in a manner similar to Example 1, except that the weight of the base paper was changed to 192 g/m$^2$ and the thickness of the base paper (substrate paper) was changed to 185 μm. The measurement and evaluation were also carried out in a manner similar to Example 1. The results of the measurement and evaluation are shown in Table 1 below.

Example 3

An inkjet recording sheet was prepared in a manner similar to Example 1, except that the weight of the base paper was changed to 182 g/m$^2$ and the thickness of the base paper (substrate paper) was changed to 175 μm, and that the coated amount of the backside coating liquid was changed from 203 ml/m$^2$ to 142 ml/m$^2$. The measurement and evaluation were also carried out in a manner similar to Example 1. The results of the measurement and evaluation are shown in Table 1 below.

Example 4

An inkjet recording sheet was prepared in a manner similar to Example 1, except that the weight of the base paper was changed to 169 g/m$^2$ and the thickness of the base paper (substrate paper) was changed to 163 nm, and that the polyvinyl alcohol used in the backside coating liquid was changed to HW-350 ((trade name) (Tg=59° C.) manufactured by Dainippon Ink & Chemicals Co., Ltd.) such that the solid coating amount of HW-350 was the same as that of the polyvinyl alcohol. The measurement and evaluation were also carried out in a manner similar to Example 1. The results of the measurement and evaluation are shown in Table 1 below.

Example 5

An inkjet recording sheet was prepared in a manner similar to Example 1, except that the weight of the base paper was changed to 169 g/m$^2$ and the thickness of the base paper (substrate paper) was changed to 163 μm, and that the backside coating liquid was changed to the following backside coating liquid B. The measurement and evaluation were also carried out in a manner similar to Example 1. The results of the measurement and evaluation are shown in Table 1 below.

—Preparation of Backside Coating Liquid B—

The following components were mixed at 30° C. to prepare a backside coating liquid B.

| <Composition of backside coating liquid> | |
|---|---|
| (1) Inorganic fine particle dispersion for backside coating liquid (see the following) | 59.5 parts |
| (2) Boric acid | 1.06 parts |
| (3) Polyvinyl alcohol (water-soluble resin) solution | 31.1 parts |
| PVA 235 (trade name) (saponification degree: 88%, polymerization degree: 3,500, manufactured by Kuraray Co., Ltd.) | 2.2 parts |
| Polyoxyethylene lauryl ether (surfactant) (EMULGEN 109P (trade name), 10% aqueous solution, HLB value: 13.6, manufactured by Kao Corporation) | 0.72 parts |
| Diethyleneglycol momobutylether (BUTYCENOL 20P (trade name), manufactured by Kyowa Hakko Kogyo Co., Ltd.) | 0.66 parts |
| Ion exchange water | 27.6 parts |
| (4) Ethanol | 2.0 parts |
| (5) Ion exchange water | 3.2 parts |
| (6) Matting agent (P-78D (trade name), aggregated particle diameter: 8 μm, manufactured by Mizusawa Industrial Chemicals, Ltd.) | 0.01 part |

(Preparation of Inorganic Fine Particle Dispersion)

The following compositions were mixed and dispersed by use of a non-media dispersing machine (ultrasonic dispersing machine manufactured by SMT Co., Ltd.), heated to 45° C. and maintained at the temperature for 20 hours, thereby preparing an inorganic fine particle dispersion for ink receiving layer.

| <Composition of inorganic fine particle dispersion> | |
|---|---|
| (1) Fumed silica (inorganic fine particles) (AEROSIL 300SF75 (trade name), manufactured by Nippon Aerosil Co., Ltd., average primary particle diameter: 7 nm) | 10.0 parts |
| (2) Ion exchange water | 65.8 parts |
| (3) SHAROL DC-902P (trade name) (51.5% aqueous solution) (dispersant, manufactured by Dai-Ichi Kogyo Seiyaku Co., Ltd.) | 0.87 parts |

Example 6

An inkjet recording sheet was prepared in a manner similar to Example 5, except that the weight of the base paper was changed to 169 g/m$^2$ and the thickness of the base paper (substrate paper) was changed to 163 μm, and that the coating amount of the backside coating liquid was changed from 203 ml/m$^2$ to 81 ml/m$^2$. The measurement and evaluation were also carried out in a manner similar to Example 5. The results of the measurement and evaluation are shown in Table 1 below.

Comparative Example 1

A comparative inkjet recording sheet was prepared in a manner similar to Example 1, except that 1050B-NE (trade name, manufactured by Dainippon Ink & Chemicals Co., Ltd.) was used in place of polyvinyl alcohol used in the backside coating solution such that the solid coating amount of 1050B-NE was the same as that of the polyvinyl alcohol. The measurement and evaluation were also carried out in a manner similar to Example 1. The results of the measurement and evaluation are shown in Table 1 below.

Comparative Example 2

A comparative inkjet recording sheet was prepared in a manner similar to Example 1, except that 1050B-NE (trade name: manufactured by Dainippon Ink & Chemicals Co., Ltd.) was used in place of polyvinyl alcohol used in the backside coating solution such that the solid coating amount of 10SOB-NE was one fourth of that of the polyvinyl alcohol. The measurement and evaluation were also carried out in a manner similar to Example 1. The results of the measurement and evaluation are shown in Table 1 below.

Comparative Example 3

A comparative inkjet recording sheet was prepared in a manner similar to Example 1, except that the weight of the base paper was changed to 208 g/m$^2$ and the thickness of the base paper (substrate paper) was changed to 200 μm, and that the backside coating liquid B prepared in Example 5 was used in place of the backside coating liquid such that the coating amount of the backside coating liquid B was twice the coating amount of the backside coating liquid (406 ml/m$^2$). The measurement and evaluation were also carried out in a manner similar to Example 1. The results of the measurement and evaluation are shown in Table 1 below.

Comparative Example 4

A comparative inkjet recording sheet was prepared in a manner similar to Example 1, except that the backside coating liquid was not used. The measurement and evaluation were also carried out in a manner similar to Example 1. The results of the measurement and evaluation are shown in Table 1 below.

Comparative Example 5

A comparative inkjet recording sheet was prepared in a manner similar to Example 1, except that HW-350 (Tg=59° C.) (trade name, manufactured by Dainippon Ink & Chemicals Co., Ltd.) was used in place of polyvinyl alcohol used in the backside coating solution such that the solid coating amount of HW-350 was twice the solid coating amount of the polyvinyl alcohol. The measurement and evaluation were also carried out in a manner similar to Example 1. The results of the measurement and evaluation are shown in Table 1 below.

Comparative Example 6

A comparative inkjet recording sheet was prepared in a manner similar to Example 4, except that the weight of the base paper was changed to 280 g/m$^2$ and the thickness of the base paper (substrate paper) was changed to 269 g/m. The measurement and evaluation were also carried out in a manner similar to Example 1. The results of the measurement and evaluation are shown in Table 1 below.

Comparative Example 7

A comparative inkjet recording sheet was prepared in a manner similar to Example 5, except that the weight of the base paper was changed to 280 g/m$^2$ and the thickness of the base paper (substrate paper) was changed to 269 μm. The measurement and evaluation were also carried out in a manner similar to Example 1. The results of the measurement and evaluation are shown in Table 1 below.

Comparative Example 8

A comparative inkjet recording sheet was prepared in a manner similar to Example 6, except that the weight of the base paper was changed to 280 g/m$^2$ and the thickness of the base paper (substrate paper) was changed to 269 μm. The measurement and evaluation were also carried out in a manner similar to Example 1. The results of the measurement and evaluation are shown in Table 1 below.

Comparative Example 9

As a comparative inkjet recording sheet, "EPSON PHOTO PAPER (Glossy) (Model No. KA420PSK" (trade name), manufactured by Seiko Epson Corp.) was subjected to the measurement and evaluation in a manner similar to Example 1. The results of the measurement and evaluation are shown in Table 1 below.

TABLE 1

| | Static friction coefficient between front and back surfaces | Static friction coefficient between back surface and roller A | Push-in deformation amount B (μm) | Rigidity C (mN · m) | Stress at break (Mpa) | Elongation at break (% GL) | Banding |
|---|---|---|---|---|---|---|---|
| Example 1 | 0.67 | 0.74 | 30.5 | 3.9 | 41 | 7.0 | A |
| Example 2 | 0.67 | 0.74 | 30.5 | 3.5 | 41 | 7.0 | A |
| Example 3 | 0.67 | 0.7 | 29.2 | 3.0 | 41 | 7.0 | A |
| Example 4 | 0.55 | 0.45 | 31.9 | 2.1 | 50 | 2.3 | B |
| Example 5 | 0.76 | 0.83 | 20.5 | 2.1 | 41 | 7.0 | B |
| Example 6 | 0.76 | 0.64 | 26 | 2.1 | 41 | 7.0 | B |
| Comparative Example 1 | 0.71 | 0.61 | 34 | 4.0 | 1.2 | 630 | C |
| Comparative Example 2 | 0.71 | 0.58 | 16 | 4.0 | 1.2 | 630 | D |
| Comparative Example 3 | 0.76 | 0.9 | 21.5 | 4.0 | 41 | 7.0 | C |
| Comparative Example 4 | 0.53 | 0.34 | 12 | 4.0 | — | — | D |
| Comparative Example 5 | 0.55 | 0.92 | 33.5 | 4.0 | 50 | 2.3 | C |
| Comparative Example 6 | 0.55 | 0.45 | 31.9 | 5.5 | 50 | 2.3 | C |
| Comparative Example 7 | 0.76 | 0.83 | 20.5 | 5.5 | 41 | 7.0 | C |
| Comparative Example 8 | 0.76 | 0.75 | 30.5 | 5.5 | 41 | 7.0 | C |
| Comparative Example 9 | 0.51 | 0.44 | 28 | 3.1 | — | — | C |

As shown in Table 1 above, banding did not occur in the inkjet recording sheets prepared in Examples 1 to 6, exhibiting a strong gripping force between the recording sheets and the roller and a high accuracy in sheet feeding.

In contrast, in Comparative Example 1, feeding accuracy was lowered by slippage of the roller due to a large amount of push-in deformation. In Comparative Example 2, feeding accuracy was lowered by slippage of the roller due to a too small amount of push-in deformation. In Comparative Example 3, banding was partially caused by the presence of both cases that the sheets were property fed and the cases that the sheets were not properly fed due to a too large static friction coefficient between the inkjet recording sheet and the roller. In Comparative Example 4, feeding accuracy was lowered by slippage of the roller due to the absence of a suitable resin coating on the back surface of the inkjet recording sheet. In Comparative Example 5, banding was caused by an excessively large feeding amount of the sheet with respect to a predetermined amount specified by the printer due to a large amount of push-in deformation and a too high static friction coefficient between the inkjet recording sheet and the roller, and by fluctuation in the feed amount. In Comparative Examples 6 to 8, rigidities were too high and that caused banding under the conditions specified by the printer. In Comparative Example 9, banding was also caused by insufficient static friction coefficient and lack of high speed printing applicability.

All publications, patent applications, and technical standards mentioned in this specification are herein incorporated by reference to the same extent as if each individual publication, patent application, or technical standard was specifically and individually indicated to be incorporated by reference.

What is claimed is:

1. An inkjet recording medium comprising:

a support;

at least one ink receiving layer formed on one surface of the support, containing at least fine particles and a water-soluble resin; and a back coat layer that is formed on the other surface of the support, the back coat layer being formed by a coating liquid essentially consisting of a) a resin, a surfactant and water, or b) a resin and water, the resin having a stress at break of from 30 to 100 MPa and an elongation at break of from 2 to 40% GL, wherein:

a static friction coefficient between an uppermost surface of the ink receiving layer side of the support and the uppermost surface of the back coat layer side of the support is in the range of from 0.46 to 0.77, and wherein the following equation is satisfied:

$$B>-30A+4C+37$$

wherein A is a static friction coefficient between the uppermost surface at the back coat layer side of the support and a metal roller onto which wear-resistant particles are adhered; B is an amount of deformation of the overall layer(s) on the back coat layer side of the support measured in μm; and C is an overall rigidity of the layers including the support, the ink receiving layer and the back coat layer measured in mM·n and wherein A, B and C are within the ranges of 0.84>A>0.44, 32>B>20 and 5>C>2, respectively.

2. The inkjet recording medium according to claim 1, wherein the fine particles contained in the ink receiving layer are at least one selected from the group consisting of silica fine particles, colloidal silica, alumina fine particles and pseudo-Boehmite particles.

3. The inkjet recording medium according to claim 1, wherein the fine particles contained in the ink receiving layer are fumed silica particles.

4. The inkjet recording medium according to claim 1, wherein the water-soluble resin is a polyvinyl alcohol resin.

5. The inkjet recording medium according to claim 4, wherein the polyvinyl alcohol resin has a saponification degree of from 70 to 100% and a polymerization degree of from 1,400 to 5,000.

6. The inkjet recording medium according to claim 1, wherein the wear-resistant particles adhered on the surface of the metal roller are at least one selected from alumina particles and silicon carbide particles.

7. The inkjet recording medium according to claim 1, wherein the ink receiving layer further contains a crosslinking agent that crosslinks the water-soluble resin.

8. The inkjet recording medium according to claim 7, wherein the crosslinking agent is a boric compound.

9. An inkjet recording method comprising applying ink onto an ink receiving layer of an inkjet recording medium, the inkjet recording medium comprising:

a support;

at least one ink receiving layer formed on one surface of the support, containing at least fine particles and a water-soluble resin; and a back coat layer that is formed on the other surface of the support, the back coat layer being formed by a coating liquid essentially consisting of a) a resin, a surfactant and water, or b) a resin and water, the resin having a stress at break of from 30 to 100 MPa and an elongation at break of from 2 to 40% GL, wherein:

a static friction coefficient between an uppermost surface of the ink receiving layer side of the support and the uppermost surface of the back coat layer side of the support is in the range of from 0.46 to 0.77, and wherein the following equation is satisfied:

$$B > -30A + 4C + 37$$

wherein A is a static friction coefficient between the uppermost surface at the back coat layer side of the support and a metal roller onto which wear-resistant particles are adhered; B is an amount of deformation of the overall layer(s) on the back coat layer side of the support measured in μm; and C is an overall rigidity of the layers including the support, the ink receiving layer and the back coat layer measured in mM·n and wherein A, B and C are within the ranges of 0.84>A>0.44, 32>B>20 and 5>C>2, respectively.

10. The inkjet recording method according to claim 9, wherein the fine particles contained in the ink receiving layer are at least one selected from the group consisting of silica fine particles, colloidal silica, alumina fine particles and pseudo-Boehmite particles.

11. The inkjet recording method according to claim 9, wherein the fine particles contained in the ink receiving layer are fumed silica particles.

12. The inkjet recording method according to claim 9, wherein the water-soluble resin is a polyvinyl alcohol resin.

13. The inkjet recording method according to claim 12, wherein the polyvinyl alcohol resin has a saponification degree of from 70 to 100% and a polymerization degree of from 1,400 to 5,000.

14. The inkjet recording method according to claim 9, wherein the wear-resistant particles adhered on the surface of the metal roller are at least one selected from alumina particles and silicon carbide particles.

15. The inkjet recording medium according to claim 9, wherein the ink receiving layer further contains a crosslinking agent that crosslinks the water-soluble resin.

16. The inkjet recording medium according to claim 9, wherein the crosslinking agent is a boric compound.

17. The inkjet recording medium according to claim 1, wherein the resin is at least one selected from the group consisting of styrene-maleic acid copolymers, styrene-acrylate copolymers, polyvinyl alcohol, silanol-modified polyvinyl alcohol, starch, cationized starch, casein, gelatin, carboxymethyl cellulose, hydroxyethyl cellulose, polyvinyl pyrrolidone, styrene-butadiene latex, acrylic emulsion, urethane-based ionomer and urethane-based emulsion.

* * * * *